US009865217B2

(12) United States Patent
Won et al.

(10) Patent No.: US 9,865,217 B2
(45) Date of Patent: Jan. 9, 2018

(54) METHOD OF DRIVING DISPLAY PANEL AND DISPLAY APPARATUS

(71) Applicant: Samsung Display Co., LTD., Yongin, Gyeonggi-Do (KR)

(72) Inventors: Myung-Ho Won, Seoul (KR); Dal-Jung Kwon, Seoul (KR); Haeng-Won Park, Seongnam-si (KR); Hyeon-Seok Bae, Suwon-si (KR); Seung-Hoon Jung, Seongnam-si (KR); Ho-Sup Choi, Seoul (KR)

(73) Assignee: Samsung Display Co., Ltd. (KR)

( * ) Notice: Subject to any disclaimer, the term of this patent is extended or adjusted under 35 U.S.C. 154(b) by 202 days.

(21) Appl. No.: 14/671,865

(22) Filed: Mar. 27, 2015

(65) Prior Publication Data

US 2015/0302816 A1 Oct. 22, 2015

(30) Foreign Application Priority Data

Apr. 21, 2014 (KR) ..... 10-2014-0047255

(51) Int. Cl.
*G09G 3/36* (2006.01)

(52) U.S. Cl.
CPC ..... *G09G 3/3685* (2013.01); *G09G 3/3681* (2013.01); *G09G 2310/0218* (2013.01); *G09G 2310/0291* (2013.01); *G09G 2320/0223* (2013.01)

(58) Field of Classification Search
None
See application file for complete search history.

(56) References Cited

U.S. PATENT DOCUMENTS

| | | | | |
|---|---|---|---|---|
| 6,407,729 | B1 * | 6/2002 | Moon | G09G 3/3648 345/205 |
| 7,936,329 | B2 | 5/2011 | Iriguchi et al. | |
| 8,570,268 | B2 | 10/2013 | Sheu et al. | |
| 2002/0084968 | A1 * | 7/2002 | Park | G09G 3/3648 345/92 |
| 2005/0057480 | A1 | 3/2005 | Liao et al. | |
| 2007/0085806 | A1 | 4/2007 | Moon | |
| 2007/0139339 | A1 | 6/2007 | Kim et al. | |
| 2008/0122875 | A1 * | 5/2008 | Qi | G09G 3/3677 345/690 |
| 2009/0102779 | A1 | 4/2009 | Jo | |

(Continued)

FOREIGN PATENT DOCUMENTS

| | | |
|---|---|---|
| KR | 10-0182177 | 4/1999 |
| KR | 10-0182017 | 5/1999 |

*Primary Examiner* — Carolyn R Edwards
*Assistant Examiner* — Bipin Gyawali
(74) *Attorney, Agent, or Firm* — Innovation Counsel LLP

(57) ABSTRACT

A method of driving a display panel includes generating a reference gate signal delayed by a predetermined period from a gate signal applied to a gate line disposed in a first end area of the display panel, the first end area being an area in which a RC delay of a data line is the smallest, receiving an input gate signal applied to a gate line disposed in a second area of the display panel, the second area being an area in which the RC delay of the data line is the largest; and selectively controlling a delay time of each of the plurality of gate signals applied to each of the plurality of gate lines according to a result of comparison between the reference gate signal and the input gate signal.

16 Claims, 6 Drawing Sheets

(56) References Cited

U.S. PATENT DOCUMENTS

| | | | | |
|---|---|---|---|---|
| 2009/0109197 | A1* | 4/2009 | Tu | G09G 3/3674 345/204 |
| 2010/0039364 | A1 | 2/2010 | Lee | |
| 2013/0234758 | A1 | 9/2013 | Renaudin et al. | |
| 2015/0279297 | A1* | 10/2015 | Nakano | G06F 3/041 345/173 |

* cited by examiner

METHOD OF DRIVING DISPLAY PANEL AND DISPLAY APPARATUS

This application claims priority to and the benefit of Korean Patent Application No. 10-2014-0047255 filed on Apr. 21, 2014, which is hereby incorporated by reference for all purposes as if fully set forth herein.

BACKGROUND

1. Field

Exemplary embodiments of the inventive concept relate to a method of driving a display panel and a display apparatus performing the method. More particularly, example embodiments of the inventive concept relate to method of driving a display panel for preventing a display quality from being degraded by driving long hours and a display apparatus performing the method of driving the display panel.

2. Description of the Related Art

Generally, a liquid crystal display LCD apparatus has a relatively small thickness, low weight and low power consumption. Thus the LCD apparatus is used in monitors, laptop computers and cellular phones, etc. The LCD apparatus includes an LCD panel displaying images using a selectively changeable light transmittance characteristic of a liquid crystal while a backlight assembly disposed under the LCD panel provides light to the LCD panel. A driving circuit drives the LCD panel and thereby causes the selective changes of the light transmittance characteristic of the liquid crystals.

The liquid display panel includes an array substrate which has a plurality of gate lines, a plurality of data lines crossing the plurality of gate lines, a plurality of thin film transistors and corresponding pixel electrodes. The liquid display panel also includes an opposing substrate which has a common electrode. A liquid crystal layer is interposed between the array substrate and opposing substrate. The driving circuit includes a gate driving part which drives the gate lines of the array substrate and a data driving part which drives the data lines.

Recently, the liquid display panel has become bigger in terms of display area DA so that a resistance-capacitance RC time delay factor that can delay gate signals transferred through the gate lines can occur.

A similar RC time delay factor can similarly delay the data signals that are transferred through respective one of the data lines. More specifically, the RC time delay can have its greatest effect on in portions of the display area farthest away from the gate driving part that is outputting the gate signals. The gate signals control a charging time during which respective data signals are charged into the pixels of a given row. When the gate signal switches to the off state, charging stops. As a result, a charging ratio may be disadvantageously decreased by increased RC time delays experienced by some of the gate signals.

Therefore, a low quality display, such as lowering of luminance, color mixing, ghost, etc, may occur due to the effects of increased RC time delay.

BRIEF SUMMARY

Exemplary embodiments of the present invention provide a method of driving a display panel capable of improving a display quality.

Exemplary embodiments of the present invention also provide a display apparatus performing the method of driving the display panel.

According to an exemplary embodiment of the inventive concept, there is provided a method of driving a display panel which comprises a plurality of data lines and a plurality of a gate lines crossing the data lines. The method includes generating a reference gate signal delayed by a predetermined period from a gate signal applied to a gate line disposed in a first end area of the display panel, the first end area being an area in which a RC delay of a data line is the smallest, receiving an input gate signal applied to a gate line disposed in a second area of the display panel, the second area being an area in which the RC delay of the data line is the largest, and selectively controlling a delay time of each of the plurality of gate signals applied to each of the plurality of gate lines according to a result of comparison between the reference gate signal and the input gate signal.

In an exemplary embodiment, the predetermined period may be substantially equal to a RC time constant of the data line in the second area.

In an exemplary embodiment, the display panel may include first to n-th gate lines which are sequentially driven, the reference gate signal is delayed by the predetermined period from a first gate signal applied to a first gate line, and the input gate signal is an n-th gate signal applied to an n-th gate line.

In an exemplary embodiment, the controlling the delay time of each of the plurality of gate signals may include outputting a comparison signal between the reference signal and the input gate signal in response to a load signal which controls an output time of a data signal applied to the data line, and generating a gate signal which is controlled a rising time with respect to a rising time of a horizontal synchronization signal according to the comparison signal.

In an exemplary embodiment, when a level of the input gate signal is more than a level of the reference signal, the comparison signal of a first polarity is output and the rising time of the gate signal is delayed from a rising time of the horizontal synchronization signal in response to the comparison signal of the first polarity.

In an exemplary embodiment, when the level of the input gate signal is less than the level of the reference signal, the comparison signal of a second polarity opposite to the first polarity is output and the rising time of the gate signal is synchronized with the rising time of the horizontal synchronization signal in response to the comparison signal of the second polarity.

In an exemplary embodiment, once the level of the input gate signal is less than the level of the reference signal, ever since the rising time of the gate signal is synchronized with the rising time of the horizontal synchronization signal in response to the comparison signal of the second polarity.

According to an exemplary embodiment of the inventive concept, there is provided a display apparatus. The display apparatus includes a display panel which comprises a plurality of data lines and a plurality of gate lines crossing the plurality of data lines;

a data driver circuit configured to output a data signal to each of the plurality of data lines, a gate driver circuit configured to sequentially output a gate signal to the plurality of gate lines, a reference signal generator configured to generate a reference gate signal delayed by a predetermined period from a gate signal applied to a gate line disposed in a first end area of the display panel, the first end area being an area in which the first end area in which a RC delay of a data line is the smallest, a delay determiner configured to compare the reference signal with an input gate signal applied to a gate line disposed in a second area of the display panel, the second area being an area in which the RC delay of the data line is the largest, and output a comparison signal generated according to a delay of the input gate signal, a control signal generator configured to output a shifting control signal which controls a delay time of each of the plurality of gate signals applied to each of the plurality of gate lines according to the comparison signal, the shifting control signal enabling or disabling a delay of each of the plurality of gate signals, and a timing controller configured to generate a gate control signal which controls the gate driver circuit according to the shifting control signal.

In an exemplary embodiment, the reference signal generator comprises an RC delay circuit, a RC time constant of the RC delay circuit being substantially equal to a RC time constant of the data line in the second end area.

In an exemplary embodiment, the display panel may include first to n-th gate lines which are sequentially driven, the reference gate signal is delayed by the predetermined period from a first gate signal applied to a first gate line, and the input gate signal is an n-th gate signal applied to an n-th gate line.

In an exemplary embodiment, the delay determiner outputs a comparison signal between the reference signal and the input gate signal in response to a load signal which controls an output time of a data signal applied to the data line, and the gate driver circuit generates a gate signal which is controlled a rising time with respect to a rising time of a horizontal sync signal according to the comparison signal.

In an exemplary embodiment, the delay determiner may include an OP amplifier which comprises an inversion terminal receiving the reference gate signal and a non-inversion terminal receiving the input gate signal, and a first transistor configured to output an output signal of the OP amplifier as the comparison signal.

In an exemplary embodiment, when a level of the input gate signal is more than a level of the reference signal, the delay determiner outputs the comparison signal of a first polarity, and when a level of the input gate signal is less than a level of the reference signal, the delay determiner outputs the comparison signal of a second polarity opposite to the first polarity.

In an exemplary embodiment, the control signal generator may include an inverter receiving the comparison signal and invert a polarity, a rectification diode including an anode connected to the inverter, a capacitor connected between a cathode of the rectification diode and a ground, and a second transistor including a control electrode connected to the cathode of the rectification diode, a first electrode receiving a source voltage and a second electrode connected to the ground.

In an exemplary embodiment, the control signal generator provides the timing controller with a first shifting control signal which delays a rising time of the gate signal with respect to a horizontal synch signal in response to the comparison signal of the first polarity.

In an exemplary embodiment, the timing controller delays a clock signal for driving the gate driver circuit with respect to the horizontal synchronization signal in response to the first shifting control signal.

In an exemplary embodiment, the control signal generator provides the timing controller with a second shifting control signal which synchronizes a rising time of the gate signal with a horizontal synch signal in response to the comparison signal of the second polarity.

In an exemplary embodiment, the timing controller may synchronize a clock signal for driving the gate driver circuit with the horizontal synchronization signal in response to the second shifting control signal.

In an exemplary embodiment, since the comparison signal of the second polarity is received, ever since the control signal generator outputs the second shifting control signal to the timing controller.

In an exemplary embodiment, the gate driver circuit generates a gate signal having a rising time in synchronization with a rising time of a clock signal.

According to the inventive concept, the delay of the gate signal is determined according to a feedback gate signal from the display panel, and the gate driver circuit may be selectively driven as the gate shifting mode or the normal gate mode in accordance with the determined delay of the gate signal. Therefore, the display quality may be prevented from being deteriorated by a characteristic distortion of the display panel due to long-term use.

BRIEF DESCRIPTION OF THE DRAWINGS

The above and other features and advantages of the inventive concept will become more apparent by describing in detailed exemplary embodiments thereof with reference to the accompanying drawings, in which.

DETAILED DESCRIPTION OF THE INVENTION

Hereinafter, the inventive concept will be explained in detail with reference to the accompanying drawings.

Figure 1:
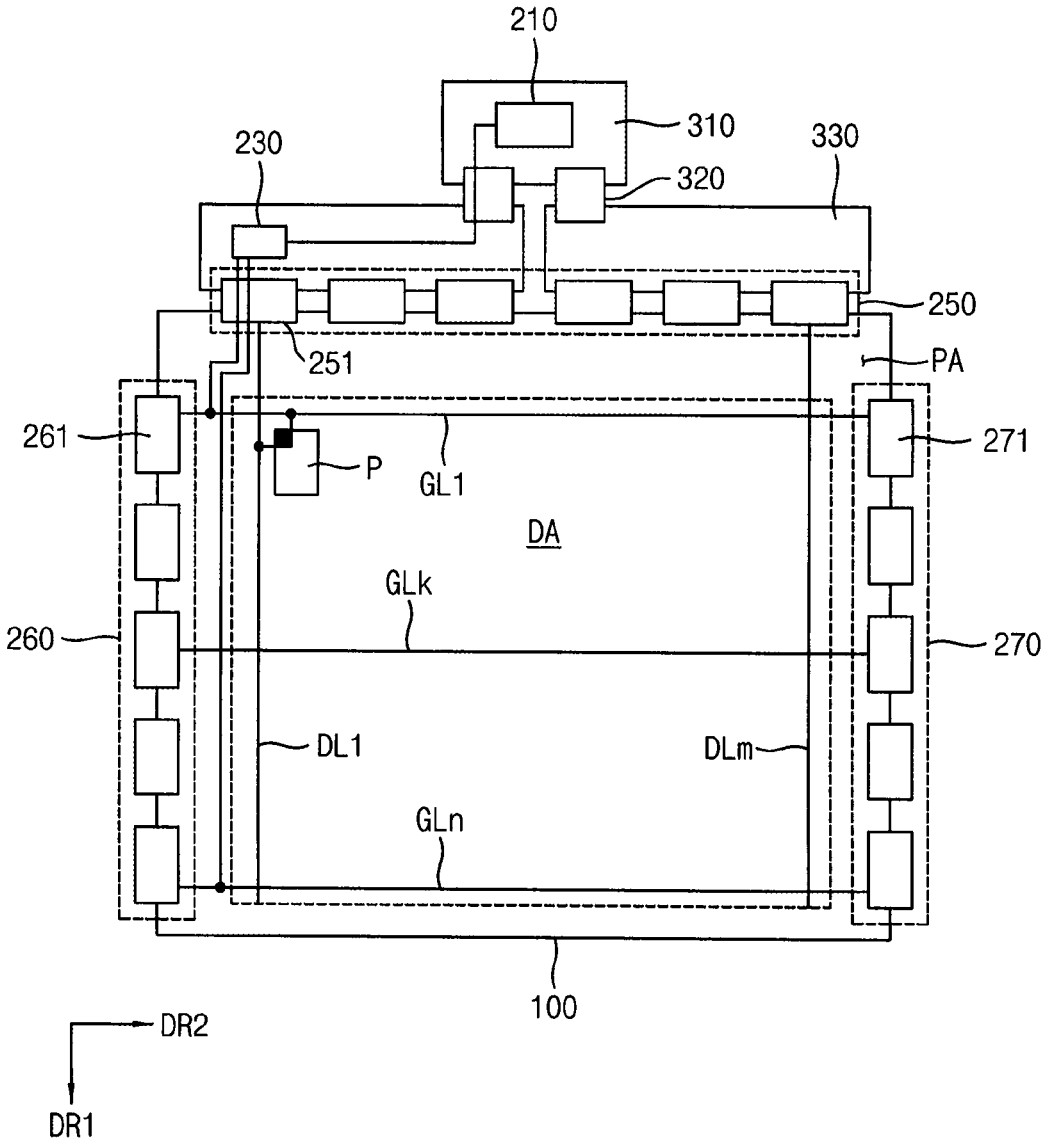
FIG. 1 is a plan view illustrating a display apparatus according to an exemplary embodiment.

FIG. 1 is a plan view illustrating a display apparatus according to an exemplary embodiment.

Referring to FIG. 1, the display apparatus may include a display panel 100, a timing controller 210, a shift control circuit 230, a data driver circuit 250, a first gate driver circuit 260 and a second gate driver circuit 270.

The display apparatus may further include a control circuit board 310, at least one flexible circuit film 320 and at least one source circuit board 330. The timing controller 210 is mounted on the control circuit board 310. A first end portion of the flexible circuit film 320 is connected to the control circuit board 310 and a second end portion of the flexible circuit film 320 is connected to the source circuit board 330. An end portion of the data driver circuit 250 is connected to the source circuit board 330. In addition, the shift control circuit 230 may be mounted on the source circuit board 230. Alternatively, the shift control circuit 230 may be mounted on the control circuit board 310.

The display panel 100 includes a display area DA and a peripheral area PA surrounding the display area DA. The display panel 100 includes a plurality of pixels P, a plurality of data lines DL1, . . . , DLm and a plurality of gate lines GL1, . . . , GLk, . . . , GLn which are disposed in the display area DA. The display panel 100 includes the data driver circuit 250, the first gate driver circuit 260 and the second gate driver circuit 270 which are disposed in the peripheral area PA.

The pixels P are arranged as a matrix type which includes a plurality of pixel columns and a plurality of pixel rows. The plurality of pixel columns includes pixels arranged in a first direction DR1. The plurality of pixel rows includes pixels arranged in a second direction DR2 crossing the first direction DR1.

The data lines DL1, . . . , DLm extend in the first direction DR1 and are arranged in the second direction DR2. Each of the data lines DL1, . . . , DLm is electrically connected to the pixels in a corresponding pixel column and transfers a data signal.

The gate lines GL1, . . . , GLn extend in the second direction DR2 and are arranged in the first direction DR1. Each of the gate lines GL1, . . . , GLk, . . . , GLn is electrically connected to the pixels in a corresponding pixel row and transfers a gate signal.

Each of the pixels P includes a switching element which is connected to a respective gate line and a respective data line and a display element which is connected to the switching element. The display element may include a liquid crystal capacitor, an organic light emitting diode, etc.

The timing controller 210 is configured to control an operation of the shift control circuit 230, the data driver circuit 250 and the first and second gate driver circuits 260 and 270.

In addition, the timing controller 210 controls the gate driver circuit 260 as a gate shifting mode or a normal gate mode in response to a shifting control signal SC received from the shift control circuit 230.

The gate shifting mode delays a gate signal applied to a gate line according to a location of the gate lines GL1, . . . , GLk, . . . , GLn. The gate shifting mode delays a gate signal along with an increase in distance from the data driver circuit 250. For example, the gate signal applied to a gate line disposed in a lower end area is delayed more than a gate signal applied to a gate line disposed in an upper end area. An RC delay of the data line is the smallest in the upper end area and is the largest in the lower end area. The upper end area of the display area DA is adjacent to an area in which the data driver circuit 250 is mounted. The lower end area is far away from an area which the data driver circuit 250 is mounted.

The gate shifting mode includes dividing the display area DA into a plurality of blocks in the first direction DR1, determining a delay time of a last block as an empirical value which can cause an insufficient margin of output enable OE time, and equally determining delay times of remaining blocks based on the delay time of the last block. For example, the display area DA is divided into 21 blocks. If a delay time of gate signals in a last block that is a 21st block is about 100 μs, a delay time of gate signal in the second block is about 5 μs. Delay times of the remaining blocks, for example, from the third block to the 21st block, are uniformly increased with an increment of 5 μs when a distance from the first block is increased. Thus, the delay time of the 21st block becomes '100 μs'.

The normal gate mode does not delay a gate signal from the horizontal sync signal. The gate signals are not affected by the RC delay of the data line, and thus, synchronize gate signals applied to gate lines with the horizontal synchronization signal. The gate signals of the second to 21st blocks are not delayed. The gate signals are delayed by the delay time of '0 μs' from the horizontal synchronization signal in the normal gate mode.

The timing controller 210 is configured to provide the data driver circuit 250 with a data signal and a data control signal. The data signal includes a color data signal. The data signal may be a corrected data signal. The corrected data signal is compensated through compensation algorithms in order to improve a response time and a full white. The data control signal may include a data synchronization signal which includes a horizontal synchronization signal, a vertical synchronization signal and a load signal which controls an output of the data signal.

The timing controller 210 provides the first and second gate driver circuits 260 and 270 with the gate control signal. The gate control signal may include a vertical start signal, at least one clock signal and an output enable OE signal, etc.

The timing controller 210 may be configured to control the clock signal based on the shifting control signal SC and to control whether or not the gate driver circuit operates as the gate shifting mode.

For example, in order to drive the first and second gate driver circuits 260 and 270 as the gate shifting mode, the timing controller 210 determines a delay time of the last block in the display area DA as a predetermined delay time using an empirical method. The timing controller 210 determines the delay times of remaining blocks in the display area DA based on the predetermined delay time of the last block. The timing controller 210 is configured to control rising times of the clock signal based on the delay times of the blocks in the display area DA.

The first and second gate driver circuits 260 and 270 are configured to generate a gate signal having a rising time synchronized with the rising timing of the clock signal. Thus, the gate signals delayed by the delay time of a corresponding block may be applied to the gate lines in the corresponding blocks.

In order to drive the first and second gate driver circuits 260 and 270 as the normal gate mode, the timing controller 210 sets the delay time of the last block as 0 μs, and determines the delay times of all remaining blocks in the display area DA as '0 μs'. Thus, the timing controller 210 is configured to generate the clock signal having the rising time synchronized with the rising time of the horizontal synchronization signal.

The first and second gate driver circuits 260 and 270 are configured to generate the gate signals based on the normal clock signal during the normal gate mode. Thus, the gate signals synchronized with the horizontal synchronization signal may be applied to the gate lines.

The shift control circuit 230 is configured to compare an input gate signal applied to the gate line disposed in the lower end area of the display area DA with the reference gate signal and to generate the shifting control signal SC. The RC delay of the data line in the lower end area of the display area DA is the largest. The gate line in the lower end area may be an n-th gate line GLn that is a last gate line. The reference gate signal is a delay gate signal delayed by a predetermined RC time constant from a gate signal applied to a first gate line GL1 disposed in the upper end area of the display area DA. The RC delay of the data line in the upper end area of the display area DA is the smallest. For example, the predetermined RC time constant may be substantially equal to an RC time constant of the data line measured at a position at which the last gate line GLn is located. Thus, the reference gate signal is the delay gate signal having a delay time based on the RC time constant of the data line at the position at which the last gate line GLn is located.

The data driver circuit 250 may include a plurality of data flexible circuit films 251 and each of the data flexible circuit films 251 may include a data driver chip which is configured to drive the data lines. The data flexible circuit film 251 electrically connects the source circuit board 330 and the display panel 100. The data flexible circuit films 251 respectively adjacent to the first and second gate driver circuits 260 and 270 among data flexible circuit films may include a plurality of dummy signal lines. The gate control signal received from the control circuit board 310 may be transferred to the first and second gate driver circuits 260 and 270 through the dummy signal lines.

The first gate driver circuit 260 may include a plurality of gate flexible circuit films 261. Each of the gate flexible circuit films 261 may include a gate driver chip which is configured to drive the gate lines. The first gate driver circuit 260 is disposed in the peripheral area PA adjacent to a first end portion of the gate line.

The second gate driver circuit 270 may include a plurality of gate flexible circuit films 271. Each of the gate flexible circuit films 271 may include a gate driver chip which is configured to drive the gate lines. The second gate driver circuit 270 is disposed in the peripheral area PA adjacent to a second end portion of the gate line.

Figure 2:
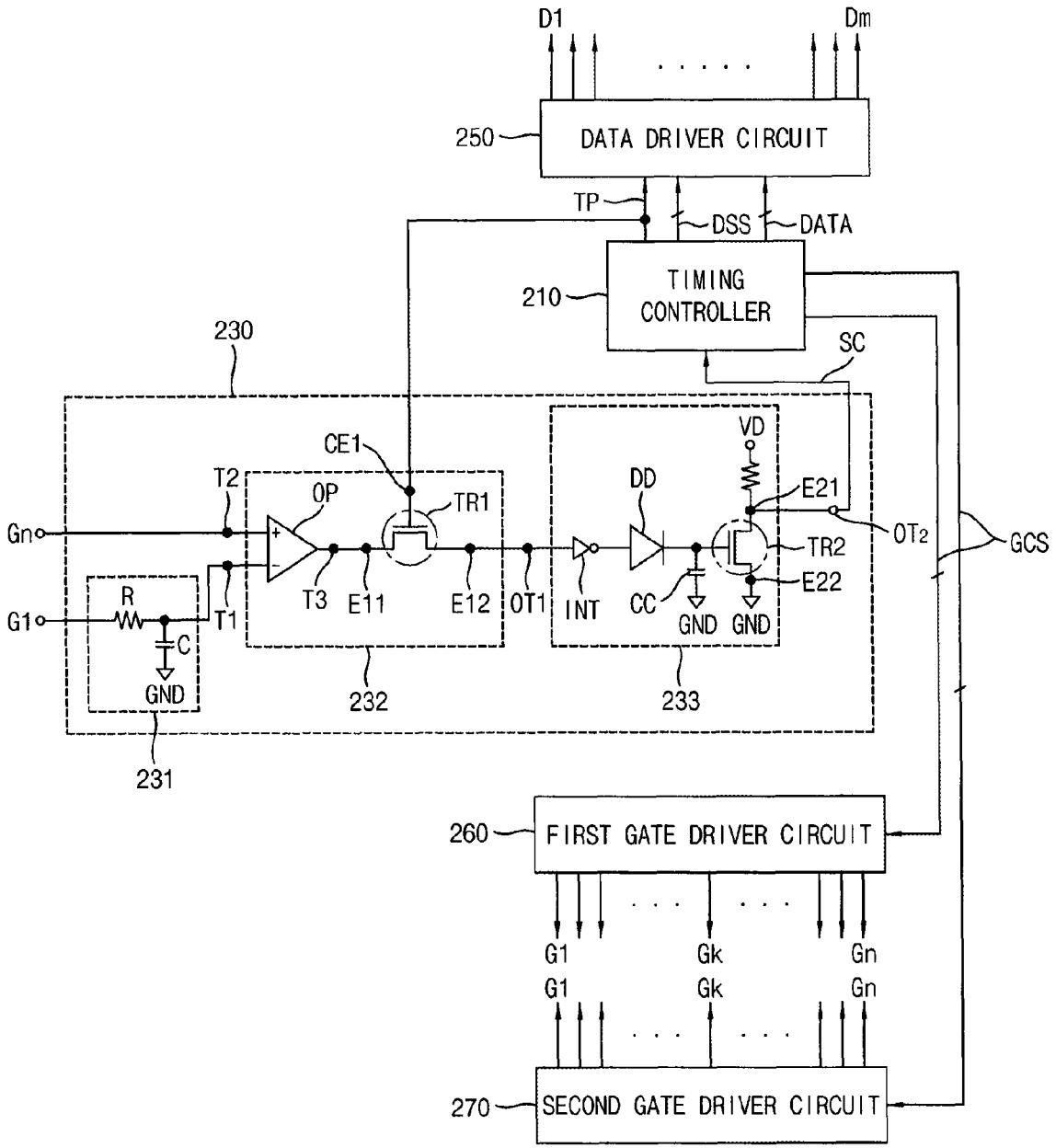
FIG. 2 is a block diagram illustrating a controlling circuits of the display apparatus as shown in FIG. 1.

FIG. 2 is a block diagram illustrating a control circuit of the display apparatus as shown in FIG. 1.

Referring to FIGS. 1 and 2, the display apparatus may include a timing controller 210, a shift control circuit 230, a data driver circuit 250, a first gate driver circuit 260 and a second gate driver circuit 270.

The timing controller 210 is configured to provide the data driver circuit 250 with a data signal DATA and a data synchronization signal. The data signal DATA includes a color data signal. The data signal DATA may be a corrected data signal compensated through compensation algorithms in order to improve a response time and a full white. The data synchronization signal DSS may include a horizontal synchronization, a vertical synchronization and a load signal TP which controls an output timing of the data signal outputted from the data driver circuit 250.

The timing controller 210 is configured to provide the first and second gate driver circuits 260 and 270 with a gate control signal GCS. The gate control signal GCS may include a vertical start signal, at least one clock signal, an output enable signal, etc.

The shift control circuit 230 may include a reference signal generator 231, a delay determiner 232 and a control signal generator 233.

The reference signal generator 231 may include an RC delay circuit. The RC delay circuit of the reference signal generator 231 may have an RC time constant of the data line measured at a position at which the last gate line GLn is located. The reference signal generator 231 is configured to receive a first gate signal G1 applied to a first gate line GL1 disposed in the upper end area having the smallest RC delay of the data line in the display area DA and to output a reference gate signal delayed by the RC time constant from the first gate signal G1.

The delay determiner 232 may include an OP amplifier OP and a first transistor TR1. The OP amplifier OP includes an inversion terminal T1, a non-inversion terminal T2 and an output terminal T3. The inversion terminal T1 receives the reference gate signal generated from the reference signal generator 231. The non-inversion terminal T2 receives an input gate signal which is an n-th gate signal Gn applied to an n-th gate line GLn disposed in the lower end area having the largest RC delay of the data line in the display area DA.

The first transistor TR1 includes a control electrode CE1 which receives the load signal TP outputted from the timing controller 210, a first electrode E11 which is connected to the output terminal T3 of the OP amplifier OP and a second electrode E12 which is connected to a first output part OT1 of the delay determiner 232.

The OP amplifier OP outputs a high level through the output terminal T3, when the n-th gate signal Gn applied to the non-inversion terminal T2 is more than the reference gate signal applied to the inversion terminal T1. However, the OP amplifier OP outputs a low level through the output terminal T3, when the n-th gate signal Gn applied to the non-inversion terminal T2 is less than the reference gate signal applied to the inversion terminal T1.

The first transistor TR1 switches in response to the load signal TP.

The first transistor TR1 is turned on when the load signal TP is at a high level and thus, outputs an output signal of the OP amplifier OP. The first transistor TR1 turns off when the load signal TP is at a low level and thus, does not output the output signal of the OP amplifier OP.

Therefore, a first output part OT1 of the delay determiner 232 outputs a comparing signal of a positive polarity or a negative polarity in response to the load signal TP. For example, the delay determiner 232 outputs the comparing signal of the positive polarity, when a level of the n-th gate signal Gn is more than a level of the reference gate signal. The delay determiner 232 outputs the comparing signal of the negative polarity, when the level of the n-th gate signal Gn is less than the level of the reference gate signal. When the comparing signal of the positive polarity is outputted, a delay of the n-th gate signal Gn is in an allowable range. When the comparing signal of the negative polarity is outputted, the delay of the n-th gate signal Gn is out of the allowable range.

The control signal generator 233 includes an inverter INT, a rectification diode DD, a capacitor CC and a second transistor TR2.

The inverter INT receives the comparing signal outputted from the delay determiner 232, inverts the comparing signal and outputs an inverted comparing signal.

The rectification diode DD includes an anode which is connected to the inverter INT and a cathode which is connected to the capacitor CC and a gate of the second transistor TR2. When the anode receives a positive polarity signal, a current flows through the rectification diode DD. When the anode receives a negative polarity signal, the current does not flow through the rectification diode DD.

The capacitor CC includes a first terminal which is connected to the cathode of the rectification diode DD and a second terminal which is connected to a ground GND. When the current flows through the rectification diode DD, the capacitor CC charges a predetermined voltage.

The second transistor TR2 includes a control electrode CE2 which is connected to the first terminal of the capacitor CC, a first electrode E21 which receives a source voltage VD and a second electrode E22 which is connected to the ground GND. The first electrode E21 of the second transistor TR2 is connected to a second output part OT2 of the control signal generator 233.

When the second transistor TR2 turns off, the second output part OT2 outputs a shifting control signal SC of a high level corresponding to the source voltage VD. When the second transistor TR turns on, the second output part OT2 outputs the shifting control signal SC of a low level corresponding to the ground GND.

According to an exemplary embodiment, the shifting control signal SC is a control signal which enables and disables the gate shifting mode. When the timing controller 210 receives the shifting control signal SC of the high level, the timing controller 210 is configured to generate a gate control signal for driving the gate driver circuit as the gate shifting mode. When the timing controller 210 receives the shifting control signal SC of the low level, the timing controller 210 is configured to generate a gate control signal for driving the gate driver circuit as the normal gate mode.

For example, when the timing controller 210 receives the shifting control signal SC of the high level, the timing controller 210 is configured to generate a delay clock signal having a rising time delayed from a rising time of the horizontal synchronization signal for driving the gate driver circuit as the gate shifting mode. When the timing controller 210 receives the shifting control signal SC of the low level, the timing controller 210 is configured to generate a normal clock signal having a rising time synchronized with the rising time of the horizontal synchronization signal for driving the gate driver circuit as the normal gate mode.

The first and second gate driver circuits 260 and 270 are configured to generate a plurality of gate signals G1, . . . , Gk, . . . , Gn having the rising time synchronized with the rising time of the delay clock signal or the normal clock signal provided from the timing controller 210.

Figure 3:
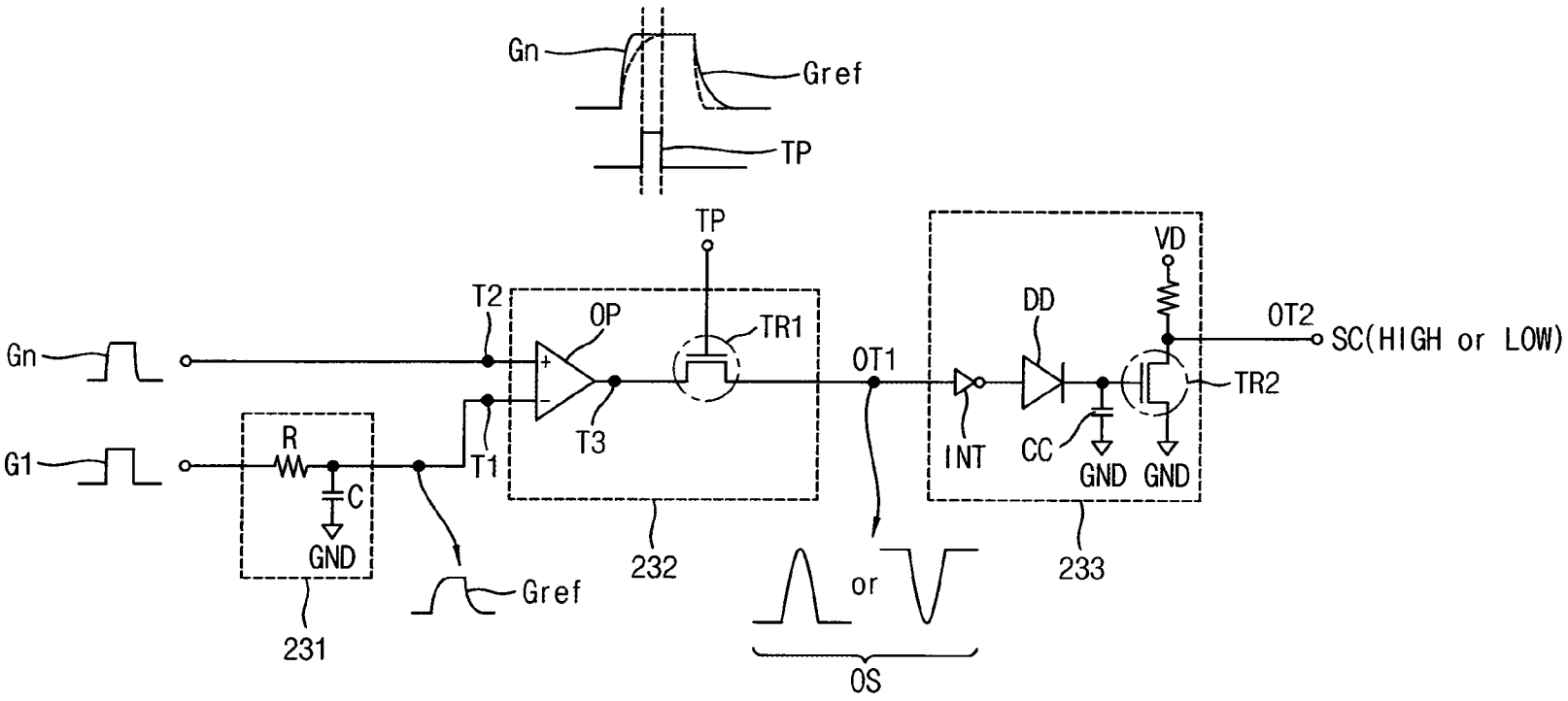
FIG. 3 is a conceptual diagram illustrating a shifting control circuit as shown in FIG. 2.

FIG. 3 is a conceptual diagram illustrating a shifting control circuit as shown in FIG. 2.

Referring to FIGS. 2 and 3, the reference signal generator 231 is configured to receive a first gate signal G1 applied to a first gate line GL1 disposed in the upper end area having the smallest RC delay of the data line in the display area DA and to output a reference gate signal delayed by the RC time constant from the first gate signal G1. The reference signal generator 231 is configured to generate a reference gate signal Gref through the RC delay circuit. The reference gate signal Gref is applied to the OP amplifier OP of the delay determiner 232.

The OP amplifier OP includes an inversion terminal T1, a non-inversion terminal T2 and an output terminal T3. The inversion terminal T1 receives the reference gate signal Gref generated from the reference signal generator 231. The non-inversion terminal T2 receives an input gate signal which is an n-th gate signal Gn applied to an n-th gate line GLn disposed in the lower end area having the largest RC delay of the data line in the display area DA.

The OP amplifier OP outputs a high level through the output terminal T3, when the n-th gate signal Gn applied to the non-inversion terminal T2 is more than the reference gate signal applied to the inversion terminal T1. However, the OP amplifier OP outputs a low level through the output terminal T3, when the n-th gate signal Gn applied to the non-inversion terminal T2 is less than the reference gate signal applied to the inversion terminal T1.

The first transistor TR1 switches in response to the load signal TP.

The first transistor TR1 turns on when the load signal TP is at a high level and thus, outputs an output signal of the OP amplifier OP. The first transistor TR1 turns off when the load signal TP is at a low level and thus, does not output the output signal of the OP amplifier OP. Therefore, a first output part OT1 of the delay determiner 232 outputs a comparing signal OS of a positive polarity or a negative polarity in response to the load signal TP.

For example, the delay determiner 232 outputs the comparing signal of the positive polarity, when a level of the n-th gate signal Gn is more than a level of the reference gate signal.

The control signal generator 233 receives the comparing signal OS of the positive polarity. The inverter INT outputs a negative polarity signal inverted from the comparing signal of the positive polarity. When the negative polarity signal is received to the anode of the rectification diode DD, the current does not flow through the rectification diode DD.

Therefore, when the second transistor TR2 turns off, the second output part OT2 of the control signal generator 233 outputs a shifting control signal SC of a high level HIGH corresponding to the source voltage VD.

The control signal generator 233 provides the timing controller 210 with the shifting control signal SC of the high level. Thus, the timing controller 210 is configured to generate a gate control signal for driving the first and second gate driver circuits 260 and 270 as the gate shifting mode in response to the shifting control signal SC of the high level.

If the load signal TP is at the high level, when the n-th gate signal Gn is less than the reference gate signal Gref, the delay determiner 232 outputs the comparing signal OS of the negative polarity.

The control signal generator 233 receives the comparing signal OS of the negative polarity. The inverter INT outputs a positive polarity signal inverted from the comparing signal of the negative polarity. When the positive polarity signal is received to the anode of the rectification diode DD, the current flows through the rectification diode DD.

Therefore, the second transistor TR2 turns on and the second output part OT2 of the control signal generator 233 outputs the shifting control signal SC of a low level LOW corresponding to the ground GND.

When the current flows through the rectification diode DD, the capacitor CC charges a predetermined voltage. The second transistor TR2 turns on by the predetermined voltage charged in the capacitor CC while the current does not flow through the rectification diode DD and the delay of the n-th gate signal Gn is in the allowable range. Thus, the second output part OT2 of the control signal generator 233 outputs the shifting control signal SC of the low level LOW corresponding to the ground GND.

According to an exemplary embodiment, the control signal generator 233 is configured to control the timing controller 210 to drive as the normal gate mode ever since the delay of the n-th gate signal Gn is out of the allowable range once.

Thus, the deterioration in display quality due to a mismatch of a characteristic of the display panel due to a long-term using and the gate shift mode may be prevented. According to an exemplary embodiment, the display apparatus controls whether the gate driver circuit drives as the gate shifting mode based on the characteristic distortion of the display panel and thus, the display quality is increased.

Figure 4:
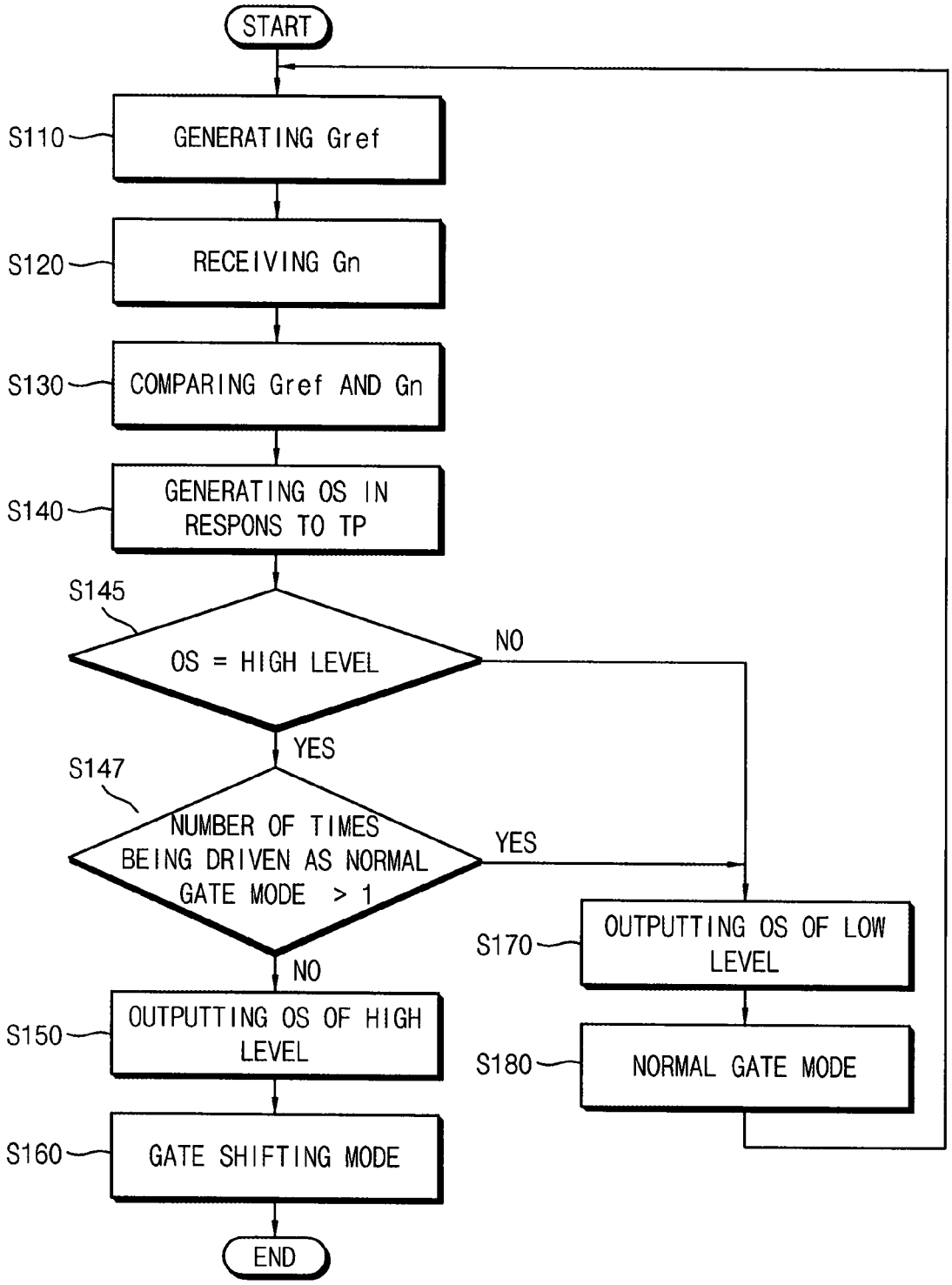
FIG. 4 is a flowchart illustrating a method of driving a display panel as shown in FIG. 1.
Figure 5A:
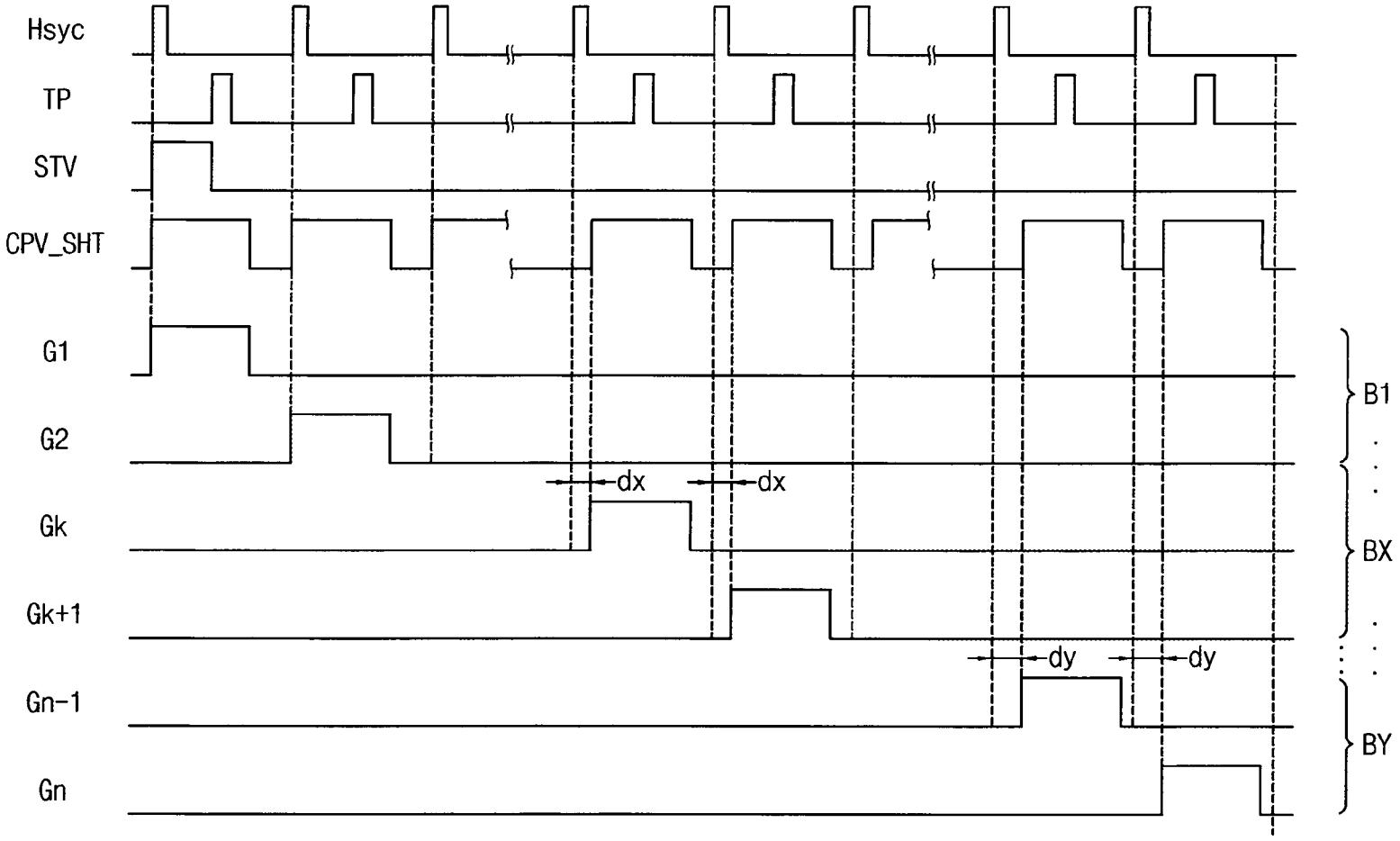
FIGS. 5A and 5B are waveform diagrams illustrating a plurality of gate signals applied to a plurality of gate lines according to the method as shown in FIG. 4.
Figure 5B:
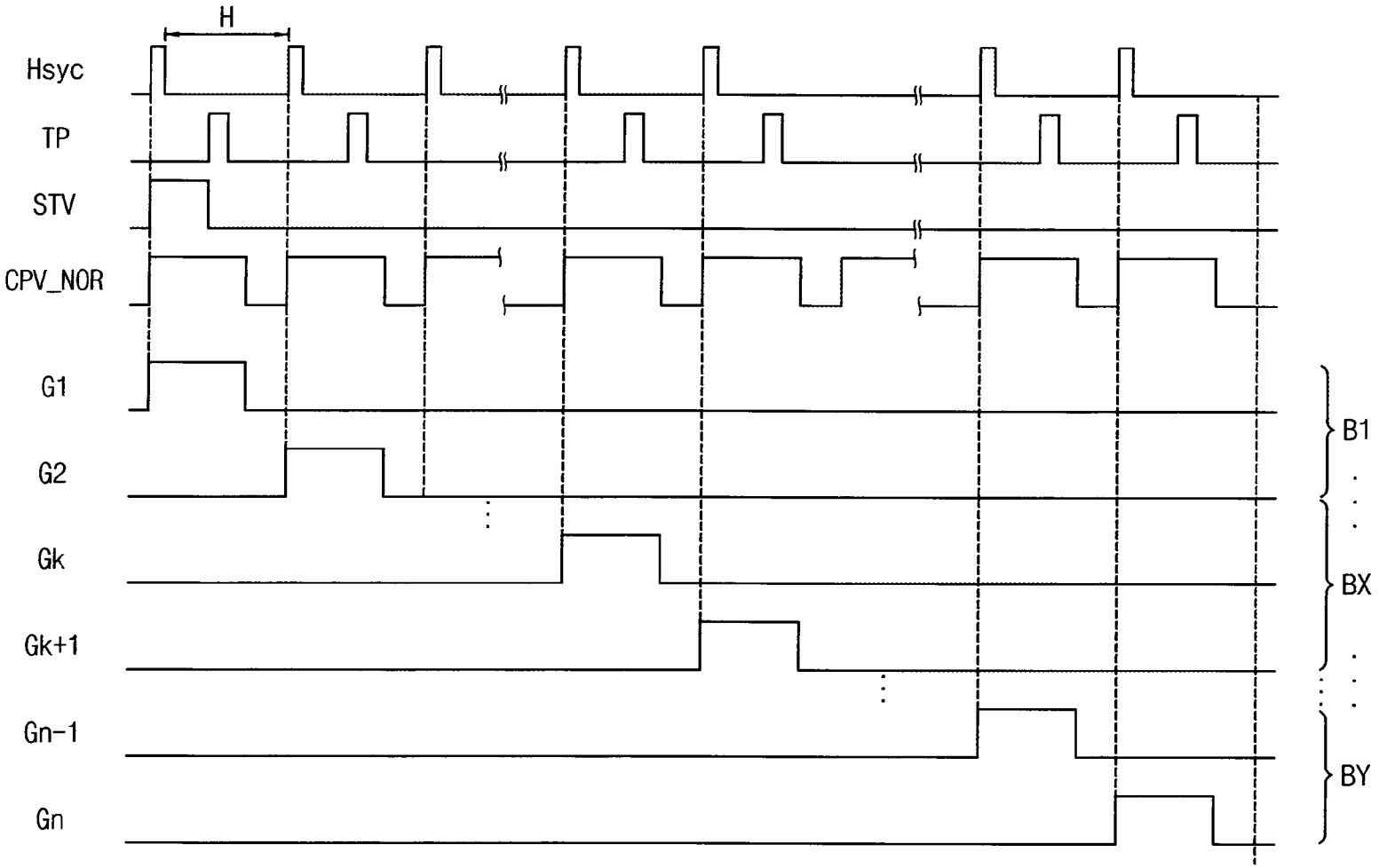

FIG. 4 is a flowchart illustrating a method of driving a display panel as shown in FIG. 1. FIGS. 5A and 5B are waveform diagrams illustrating a plurality of gate signals applied to a plurality of gate lines according to the method as shown in FIG. 4.

Referring to FIGS. 3 and 4, the reference signal generator 231 is configured to receive a first gate signal G1 applied to a first gate line GL1 disposed in the upper end area having the smallest RC delay of the data line in the display area DA and to output a reference gate signal Gref delayed by the RC time constant from the first gate signal G1. The reference signal generator 231 is configured to generate a reference gate signal Gref delayed by the RC time constant from the first gate signal G1 (Step S110). The reference gate signal Gref is applied to a non-inversion terminal T1 of the OP amplifier OP.

An inversion terminal T2 of the OP amplifier OP receives an input gate signal which is an n-th gate signal Gn applied to an n-th gate line GLn disposed in the lower end area having the largest RC delay of the data line in the display area DA (Step S120).

The OP amplifier OP outputs a high level through the output terminal T3, when the n-th gate signal Gn applied to the non-inversion terminal T2 is more than the reference gate signal Gref applied to the inversion terminal T1. However, the OP amplifier OP outputs a low level through the output terminal T3, when the n-th gate signal Gn applied to the non-inversion terminal T2 is less than the reference gate signal Gref applied to the inversion terminal T1 (Step S130).

The first transistor TR1 outputs a comparing signal OS in response to the load signal TP (Step S140). The first transistor TR1 turns on when the load signal TP is at a high level and thus, outputs an output signal of the OP amplifier OP. The first transistor TR1 turns off when the load signal TP is at a low level and thus, does not output the output signal of the OP amplifier OP.

If the load signal TP is at the high level, when the n-th gate signal Gn is more than the reference gate signal Gref, the first output part OT1 of the delay determiner 232 outputs the comparing signal OS of the positive polarity (Step S145).

The control signal generator 233 is configured to receive the comparing signal OS of the positive polarity. The inverter INT inverts the comparing signal OS of the positive polarity into a negative polarity signal. The negative polarity signal is applied to the anode of the rectification diode DD and thus, the current does not flow through the rectification diode DD.

Thus, the second transistor TR2 turns off and the second output part OT2 of the control signal generator 233 outputs a shifting control signal SC of a high level HIGH corresponding to the source voltage VD (Step S150).

The shifting control signal SC of the high level HIGH is provide to the timing controller 210 and then, the timing controller 210 is configured to generate a gate control signal corresponding to the gate shifting mode in response to the shifting control signal SC of the high level HIGH.

Referring to FIG. 5A, a rising time of the timing controller generate a delay clock signal CPV_SHT.

For example, the display area of the display panel is divided into first to Y-th blocks B1, . . . , BY, and each of the first to Y-th blocks B1, . . . , BY includes a plurality of gate lines. First and second gate lines are disposed in a first block B1, k-th and (k+1)-th are disposed in an X-th block and n-th−1 and n-th gate lines are disposed in a Y-th block BY (wherein, k, n, X and Y are a natural number).

The timing controller determines delay times of the second to (Y−1)-th blocks by referring to a first delay time dy of the Y-th block BY which is the last block of the display area, in response to the shifting control signal SC of the high level HIGH. For example, the X-th block BX which is located in a middle of the display area may have a second delay time dx less than the first delay time dy.

The timing controller is configured to generate a delay clock signal CPV_SHT which has rising time delayed by the delay times of the second to Y-th blocks B1, . . . , BY.

Therefore, the rising time of the clock signal CPV_SHT corresponding to the first block B1 is not delayed from a rising time of the horizontal synchronization signal Hsyc. The rising time of the clock signal CPV_SHT corresponding to the X-th block synchronization is delayed by the second delay time dx from a rising time of the horizontal synchronization signal Hsyc. The rising time of the clock signal CPV_SHT corresponding to the Y-th block BY is delayed by the first delay time dy from a rising time of the horizontal synchronization signal Hsyc.

The first and second gate driver circuits are configured to generate a plurality of gate signals based on the delay clock signal CPV_SHT.

A rising time of first and second gate signals G1 and G2 corresponding to the first block B1 is not delayed from a rising time of the horizontal synchronization signal Hsyc. A rising time of k-th and (k+1)-th gate signals Gk and Gk+1 corresponding to the x-th block BX is delayed by the second delay time dx from a rising time of the horizontal synchronization signal Hsyc. A rising time of (n−1)-th and n-th gate signals corresponding to the Y-th block BY is delayed by the first delay time dy from a rising time of the horizontal synchronization signal Hsyc.

Therefore, the first and second gate driver circuits are driven as the gate shifting mode (Step S160).

If the load signal TP is at a high level, when the n-th gate signal Gn is less than the reference gate signal Gref, the first output part OT1 of the delay determiner 232 outputs the comparing signal OS of the negative polarity (Step S145).

The control signal generator 233 is configured to receive the comparing signal OS of the negative polarity. The inverter INT inverts the comparing signal OS of the negative polarity into a positive polarity signal. The positive polarity signal is applied to the anode of the rectification diode DD and thus, the current flows through the rectification diode DD.

The second transistor TR2 turns on, and then the second output part OT2 of the control signal generator 233 outputs the shifting control signal SC of a low level LOW corresponding to the ground GND (Step S170).

The shifting control signal SC of the low level LOW is provides to the timing controller 210 and the timing controller 210 is configured to generate the gate control signal corresponding to the normal gate mode in response to the shifting control signal SC of the low level LOW.

Referring to FIG. 5B, the timing controller is configured to generate a normal clock signal CPV_NOR in synchronization with the horizontal synchronization signal Hsyc.

For example, the display area of the display panel is divided into first to Y-th blocks B1, . . . , BY, and each of the first to Y-th blocks B1, . . . , BY includes a plurality of gate lines. First and second gate lines are disposed in a first block B1, k-th and (k+1)-th are disposed in an X-th block and n-th−1 and n-th gate lines are disposed in a Y-th block BY (wherein, k, n, X and Y are a natural number).

The timing controller determines delay times of all the first to (Y−1)-th blocks into '0 μs' by referring to a delay time '0 μs' of the Y-th block BY which is the last block of the display area, in response to the shifting control signal SC of the low level LOW.

The timing controller is configured to generate a normal clock signal CPV_NOR which has rising time delayed by the delay time '0 μs' of all the first to Y-th blocks B1, . . . , BY.

The first and second gate driver circuits are configured to generate a plurality of gate signals based on the normal clock signal CPV_NOR.

The first and second gate driver circuits sequentially outputs normal first to n-th gate signals G1, G2, . . . , Gk, Gk+1, . . . , Gn−1, Gn which are synchronized with the horizontal synchronization signal Hsyc. The first and second gate driver circuits are driven as the normal gate mode (Step S180).

Since the first and second gate driver circuits are driven as the normal gate mode once after the first and second gate driver circuits have been driven as the normal gate mode (Step S147), the control signal generator 233 outputs the shifting control signal SC of the low level LOW even though the control signal generator 233 receives comparing signal OS of the high level. Thus, the timing controller 210 is driven as the normal gate mode.

Therefore, deterioration in a display quality due to a mismatch of a characteristic of the display panel and the gate shifting mode may be prevented.

As described above, according to exemplary embodiments, the delay of the gate signal is determined based on a feedback gate signal from the display panel, and the gate driver circuit may be selectively driven as the gate shifting mode or the normal gate mode in accordance with the determined delay of the gate signal. Therefore, the display quality may be prevented from being deteriorated due to a mismatch between a characteristic of the display panel and the gate shift mode.

The foregoing is illustrative of the inventive concept and is not to be construed as limiting the scope of the inventive concept. Although a few exemplary embodiments of the inventive concept have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A method of driving a display panel which comprises a plurality of data lines and a plurality of a gate lines crossing the data lines, the method comprising:

generating a reference gate signal delayed by a predetermined period from a gate signal applied to a gate line disposed in a first end area of the display panel, the first end area being an area in which a RC delay of a data line is the smallest;

receiving an input gate signal applied to a gate line disposed in a second area of the display panel, the second area being an area in which the RC delay of the data line is the largest; and selectively controlling a rising time of each of the plurality of gate signals applied to each of the plurality of gate lines according to a result of comparison between the reference gate signal and the input gate signal, wherein the controlling the rising time of each of the plurality of gate signals comprises:

outputting a comparison signal between the reference signal and the input gate signal in response to a load signal which controls an output time of a data signal applied to the data line; and generating a gate signal whose rising time is controlled with respect to a rising time of a horizontal synchronization signal according to the comparison signal, and wherein when a level of the input gate signal is more than a level of the reference signal, the comparison signal of a first polarity is output and the rising time of the gate signal is delayed from the rising time of the horizontal synchronization signal in response to the comparison signal of the first polarity.

2. The method of claim 1, wherein the predetermined period is substantially equal to a RC time constant of the data line in the second area.

3. The method of claim 1, wherein the display panel comprises first to n-th gate lines which are sequentially driven, the reference gate signal is delayed by the predetermined period from a first gate signal applied to a first gate line, and the input gate signal is an n-th gate signal applied to an n-th gate line.

4. The method of claim 1, wherein when the level of the input gate signal is less than the level of the reference signal, the comparison signal of a second polarity opposite to the first polarity is output and the rising time of the gate signal is synchronized with the rising time of the horizontal synchronization signal in response to the comparison signal of the second polarity.

5. The method of claim 4, wherein once the level of the input gate signal is less than the level of the reference signal, ever since the rising time of the gate signal is synchronized with the rising time of the horizontal synchronization signal in response to the comparison signal of the second polarity.

6. A display apparatus comprising:

a display panel which comprises a plurality of data lines and a plurality of gate lines crossing the plurality of data lines;

a data driver circuit configured to output a data signal to each of the plurality of data lines;

a gate driver circuit configured to sequentially output a gate signal to the plurality of gate lines;

a reference signal generator configured to generate a reference gate signal delayed by a predetermined period from a gate signal applied to a gate line disposed in a first end area of the display panel, the first end area being an area in which the first end area in which a RC delay of a data line is the smallest;

a delay determiner configured to compare the reference signal with an input gate signal applied to a gate line disposed in a second area of the display panel, the second area being an area in which the RC delay of the data line is the largest, and output a comparison signal generated according to a delay of the input gate signal;

a control signal generator configured to output a shifting control signal which controls a rising time of each of the plurality of gate signals applied to each of the plurality of gate lines according to the comparison signal, the shifting control signal enabling or disabling a delay of each of the plurality of gate signals; and a timing controller configured to generate a gate control signal which controls the gate driver circuit according to the shifting control signal, wherein the delay determiner outputs a comparison signal between the reference signal and the input g ate signal in response to a load signal which controls an output time of a data signal applied to the data line, and the gate driver circuit generates a gate signal whose rising time is controlled with respect to a rising time of a horizontal sync signal according to the comparison signal, and wherein the delay determiner comprise:

an OP amplifier which comprises an inversion terminal receiving the reference g ate signal and an non-inversion terminal receiving the input g ate signal; and a first transistor configured to output an output signal of the OP amplifier as the comparison signal.

7. The display apparatus of claim 6, wherein the reference signal generator comprises an RC delay circuit, a RC time constant of the RC delay circuit being substantially equal to a RC time constant of the data line in the second end area.

8. The display apparatus of claim 6, wherein the display panel comprises first to n-th gate lines which are sequentially driven, the reference gate signal is delayed by the predetermined period from a first gate signal applied to a first gate line, and the input gate signal is an n-th gate signal applied to an n-th gate line.

9. The display apparatus of claim 8, wherein when a level of the input gate signal is more than a level of the reference signal, the delay determiner outputs the comparison signal of a first polarity, and when a level of the input gate signal is less than a level of the reference signal, the delay determiner outputs the comparison signal of a second polarity opposite to the first polarity.

10. The display apparatus of claim 9, wherein the control signal generator comprises:

an inverter receiving the comparison signal and invert a polarity;

a rectification diode including an anode connected to the inverter;

a capacitor connected between a cathode of the rectification diode and a ground; and a second transistor including a control electrode connected to the cathode of the rectification diode, a first electrode receiving a source voltage and a second electrode connected to the ground.

11. The display apparatus of claim 10, herein the control signal generator provides the timing controller with a first shifting control signal which delays a rising time of the gate signal with respect to a horizontal synch signal in response to the comparison signal of the first polarity.

12. The display apparatus of claim 11, wherein the timing controller delays a clock signal for driving the gate driver circuit with respect to the horizontal synchronization signal in response to the first shifting control signal.

13. The display apparatus of claim 10, wherein the control signal generator provides the timing controller with a second shifting control signal which synchronizes a rising time of the gate signal with a horizontal synch signal in response to the comparison signal of the second polarity.

14. The display apparatus of claim 13, wherein the timing controller synchronizes a clock signal for driving the gate driver circuit with the horizontal synchronization signal in response to the second shifting control signal.

15. The display apparatus of claim 14, wherein since the comparison signal of the second polarity is received, ever since the control signal generator outputs the second shifting control signal to the timing controller.

16. The display apparatus of claim 6, wherein the gate driver circuit generates a gate signal having a rising time in synchronization with a rising time of a clock signal.

* * * * *